US011646530B2

(12) United States Patent
Watkins et al.

(10) Patent No.: US 11,646,530 B2
(45) **Date of Patent: *May 9, 2023**

(54) COAXIAL CABLE CONNECTOR SLEEVE WITH CUTOUT

(71) Applicant: PPC BROADBAND, INC., East Syracuse, NY (US)

(72) Inventors: Harold J. Watkins, Chittenango, NY (US); Steve Stankovski, Clay, NY (US); Daniel Daoust, Syracuse, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/316,954

(22) Filed: May 11, 2021

(65) Prior Publication Data

US 2021/0336381 A1 Oct. 28, 2021

Related U.S. Application Data

(63) Continuation of application No. 16/799,824, filed on Feb. 24, 2020, now Pat. No. 11,005,212.

(60) Provisional application No. 62/809,299, filed on Feb. 22, 2019.

(51) Int. Cl.
*H01R 13/622* (2006.01)

(52) U.S. Cl.
CPC ..... *H01R 13/622* (2013.01)

(58) Field of Classification Search
CPC . H01R 9/0521; H01R 13/5205; H01R 13/622
See application file for complete search history.

(56) References Cited

U.S. PATENT DOCUMENTS

| | | | | |
|---|---|---|---|---|
| 4,165,911 | A | 8/1979 | Laudig | |
| 6,109,964 | A | 8/2000 | Kooiman | |
| 7,128,605 | B2 | 10/2006 | Montena | |
| 7,354,309 | B2 * | 4/2008 | Palinkas | H01R 9/0521 439/588 |
| 7,997,930 | B2 | 8/2011 | Ehret et al. | |
| 9,017,101 | B2 * | 4/2015 | Ehret | H01R 9/05 29/874 |

(Continued)

OTHER PUBLICATIONS

Search Report dated Jun. 8, 2020 in corresponding International Patent Application No. PCT/US2020/019558, 2 pages.

(Continued)

*Primary Examiner* — Abdullah A Riyami
*Assistant Examiner* — Nader J Alhawamdeh
(74) *Attorney, Agent, or Firm* — MH2 Technology Law Group LLP

(57) ABSTRACT

A torque sleeve includes sleeve body configured to extend along an axis. The sleeve body is further configured to at least partially receive a coupling member of a coaxial cable connector. The sleeve body has an outer surface configured to permit a user to tighten the coupling member to an interface port up to a first torque, and the sleeve body includes a pair of opposed cutouts configured to receive a tightening tool so as to permit the tightening tool to grip the coupling member and tighten the coupling member to an interface port up to a second torque, the second torque being greater than the first torque.

30 Claims, 6 Drawing Sheets

(56) References Cited

U.S. PATENT DOCUMENTS

| | | | | |
|---|---|---|---|---|
| 9,124,046 | B2 * | 9/2015 | Ehret | H01R 43/26 |
| 9,595,776 | B2 * | 3/2017 | Ehret | H01R 13/5025 |
| 11,005,212 | B2 * | 5/2021 | Watkins | H01R 13/622 |
| 2006/0063426 | A1 | 3/2006 | Khemakhem et al. | |
| 2007/0123101 | A1 * | 5/2007 | Palinkas | H01R 9/0521 439/579 |
| 2009/0163075 | A1 | 6/2009 | Blew et al. | |
| 2011/0230089 | A1 * | 9/2011 | Amidon | H01R 13/6593 29/874 |
| 2012/0003869 | A1 * | 1/2012 | Ehret | H01R 24/54 439/578 |
| 2012/0270439 | A1 | 10/2012 | Tremba et al. | |
| 2015/0180183 | A1 * | 6/2015 | Watkins | H01R 13/6584 439/578 |
| 2016/0248178 | A1 | 8/2016 | Hammons et al. | |
| 2018/0054017 | A1 | 2/2018 | Watkins et al. | |
| 2019/0334296 | A1 * | 10/2019 | Watkins | H01R 13/622 |
| 2019/0341705 | A1 * | 11/2019 | Watkins | H01R 13/5219 |
| 2019/0372280 | A1 | 12/2019 | Youtsey | |

OTHER PUBLICATIONS

Written Opinion dated Jun. 8, 2020 in corresponding International Patent Application No. PCT/US2020/019558, 5 pages.

International Preliminary Report on Patentability dated Aug. 10, 2021 in corresponding International Patent Application No. PCT/US2020/019558, 6 pages.

* cited by examiner

COAXIAL CABLE CONNECTOR SLEEVE WITH CUTOUT

CROSS-REFERENCE TO RELATED APPLICATION

This application is a continuation of U.S. Nonprovisional patent application Ser. No. 16/799,824, filed Feb. 24, 2020, pending, which claims the benefit of U.S. Provisional Application No. 62/809,299, filed Feb. 22, 2019, the disclosures of which are incorporated by reference herein in their entireties.

TECHNICAL FIELD

This disclosure relates generally to coaxial cable connectors and, more specifically, to a sleeve adapted to assist in tightening a threaded nut of a connector to a port or fitting.

BACKGROUND

In using electronic devices such as cable boxes and cable modems, it is sometimes desired to connect such devices to televisions, digital video disc playback devices, digital video recorders, personal computers, or other sources of electronic signals. Typically, a coaxial cable supplied by a cable service company penetrates a wall in the user's premises and is distributed to one or more locations within the home through the use of additional coaxial cable segments typically referred to as jumper cables. The jumper cable is terminated near the location of the television, cable box, cable modem or digital phone. Each end of a jumper has a coaxial cable connector installed thereon. A common interface for the coaxial cable connector is an internally threaded rotatable nut. The connector threads onto an externally threaded port on the cable box, cable modem, or other device. Other devices may be connected to the cable box or cable modem using similarly configured coaxial cable jumpers and connectors.

Conventional coaxial cable typically contains a centrally located electrical conductor surrounded by and spaced inwardly from an outer cylindrical braided conductor or sheath. The center and braid conductors are separated by a foil and an insulator core, with the braid being encased within a protective outer jacket.

A first end of a conventional coaxial cable typically includes an inner cylindrical post adapted to be inserted into a suitably prepared end of the cable between the foil and the outer braid conductor, an end portion of the latter having been exposed and folded back over the protective jacket. The center conductor, the insulator core, and the foil thus form a central core portion of the cable received axially in the inner post, whereas the outer braided conductor and protective jacket comprise an outer portion of the cable surrounding the inner post. The conventional coaxial cable end connector further includes a connector body and/or compression member designed to coact with the inner post to securely and sealingly clamp the outer portion of the cable therebetween. The clamping to the jumper cable may be carried out by crimping, swaging or radial compression of connector body or compression sleeve by use of special tools adapted to mate with these components.

The second end of the connector typically includes an internally threaded nut rotatably secured to the connector body. The nut may be secured to a corresponding threaded port on the cable box, television, or other electronic device. The nut may be tightened using an appropriately sized wrench. To establish a reliable connection between the connector and the port, the nut must be threadedly advanced until a flange on the end of the post contacts then end face of the port.

One drawback to this tightening approach is that often space is very limited in the back of the electronic device and there is inadequate room for a wrench. For example, the cable box or television may be located within an entertainment console and access to port on the equipment may be limited. Or, access to a television housed in an entertainment console may be limited because the television may be too large or heavy to be moved.

Another drawback is that the person making the connection may be unaware of the proper method of establishing a reliable connection. In some instances, particularly when a wrench is unavailable, the user may cease hand-tightening after one or two turns. Although such a loose connection may provide adequate video signal, data transmission may be severely hampered or break down completely. Data transmission problems may affect voice over internet protocol (VOIP), for example.

SUMMARY

According to various embodiments of the disclosure, a torque sleeve is configured to be coupled to a coaxial cable connector, which is used to terminate a prepared end of a coaxial cable. The torque sleeve comprises a sleeve body configured to extend about a periphery of a coupler and be coupled with the coupler. The sleeve body includes a bore configured to define an interior surface that includes a torque transmission feature, the torque transmission feature defining a hexagonal shape configured to match a hexagonal outer surface of the coupler. The sleeve body includes a pair of opposed cutouts, each of the cutouts extending about a portion of a periphery of the coupler, the cutouts being configured to be aligned with opposed flat surfaces of the hexagonal outer surface of the coupler. Each of the cutouts is sized and arranged to receive one flat surface of the hexagonal outer surface of the coupler and two corner portions of the hexagonal outer surface of the coupler, the corner portions being at each end the flat surface in a direction about a periphery of the coupler. The cutouts are configured to receive jaws of a wrench and permit such jaws to engage the flat surface and/or the two corner portions that are exposed in each of the cutouts such that the wrench can grip the coupler to tighten the coupler to an interface port up to a second desired torque that is greater than a first torque attainable via hand tightening.

In some aspects, a connector assembly includes the torque sleeve and a connector including a coupler, a post member coupled with the coupler, a connector body coupled with the post, and a fastener member configured to coupled the connector with the prepared end of the coaxial cable. The coupler is configured to rotate relative to the post member and the connector body.

In various aspects, the coupler includes a forward portion having an annular outer surface and a rearward portion having the hexagonal outer surface.

According to some aspects, the connector assembly includes a forward grounding member coupled with the forward portion of the coupler.

According to various aspects, the forward grounding member includes a rear collar portion and forward grounding fingers, the forward grounding fingers being configured to extend forward from the coupler. In some aspect, the grounding fingers are configured to project radially inward from the rear collar portion such that an inside diameter of the grounding fingers is smaller than an outside diameter of an interface port, the grounding fingers are configured to deflect radially outward to receive the interface port therein when the coupler is coupled with the interface port, and the fingers are configured to remain biased radially inward to maintain constant contact with the threaded exterior surface of the interface port even when the coupler is not fully tightened to the interface port.

In some aspects, a connector assembly includes the torque sleeve and a connector including a coupler, a post member coupled with the coupler, a connector body coupled with the post, and a fastener member configured to coupled the connector with the prepared end of the coaxial cable. The coupler is configured to rotate relative to the post member and the connector body.

In various aspects, the coupler includes a forward portion having an annular outer surface and a rearward portion having the hexagonal outer surface.

According to some aspects, the connector assembly includes a forward grounding member coupled with the forward portion of the coupler.

According to some aspects of the disclosure, a torque sleeve is configured to be coupled to a coaxial cable connector. The torque sleeve includes a sleeve body configured to extend about a periphery of a coupler and be coupled with the coupler. The sleeve body includes a pair of opposed cutouts, each of the cutouts extending about a portion of a periphery of the coupler, the cutouts being configured to be aligned with opposed flat surfaces of a hexagonal outer surface of a coupler. Each of the cutouts is sized and arranged to receive one flat surface of the hexagonal outer surface of the coupler and two corner portions of the hexagonal outer surface of the coupler, the corner portions being at each end the flat surface in a direction about a periphery of the coupler. The cutouts are configured to receive jaws of a wrench and permit such jaws to engage the flat surface and/or the two corner portions that are exposed in each of the cutouts such that the wrench can grip the coupler to tighten the coupler to an interface port up to a second desired torque that is greater than a first torque attainable via hand tightening.

In some aspects, a connector assembly includes the torque sleeve and a connector including a coupler, a post member coupled with the coupler, a connector body coupled with the post, and a fastener member configured to coupled the connector with the prepared end of the coaxial cable. The coupler is configured to rotate relative to the post member and the connector body.

In various aspects, the coupler includes a forward portion having an annular outer surface and a rearward portion having the hexagonal outer surface.

According to some aspects, the connector assembly includes a forward grounding member coupled with the forward portion of the coupler.

In various embodiments, a torque sleeve includes sleeve body configured to extend along an axis, the sleeve body further configured to at least partially receive a coupling member of a coaxial cable connector. The sleeve body has an outer surface configured to permit a user to tighten the coupling member to an interface port up to a first torque, and the sleeve body includes a pair of opposed cutouts configured to receive a tightening tool so as to permit the tightening tool to grip the coupling member and tighten the coupling member to an interface port up to a second torque, the second torque being greater than the first torque.

In some aspects, a connector assembly includes the torque sleeve and a connector including a coupler, a post member coupled with the coupler, a connector body coupled with the post, and a fastener member configured to coupled the connector with the prepared end of the coaxial cable. The coupler is configured to rotate relative to the post member and the connector body.

In various aspects, the coupler includes a forward portion having an annular outer surface and a rearward portion having the hexagonal outer surface.

According to some aspects, the connector assembly includes a forward grounding member coupled with the forward portion of the coupler.

In some aspects, the sleeve body includes a bore configured to define an interior surface that includes a torque transmission feature, the torque transmission feature defining a hexagonal shape configured to match a hexagonal outer surface of the coupler.

In various aspects, each of the cutouts is sized and arranged to receive one flat surface of the hexagonal outer surface of the coupler and two corner portions of the hexagonal outer surface of the coupler, the corner portions being at each end the flat surface in a direction about a periphery of the coupler.

BRIEF DESCRIPTION OF THE FIGURES

For a further understanding of the invention, reference will be made to the following detailed description of the invention which is to be read in connection with the accompanying drawing and in which like numbers refer to like parts, wherein.

DETAILED DESCRIPTION

As a preface to the detailed description, it should be noted that, as used in this specification and the appended claims, the singular forms "a", "an" and "the" include plural referents, unless the context clearly dictates otherwise.

Figure 1:
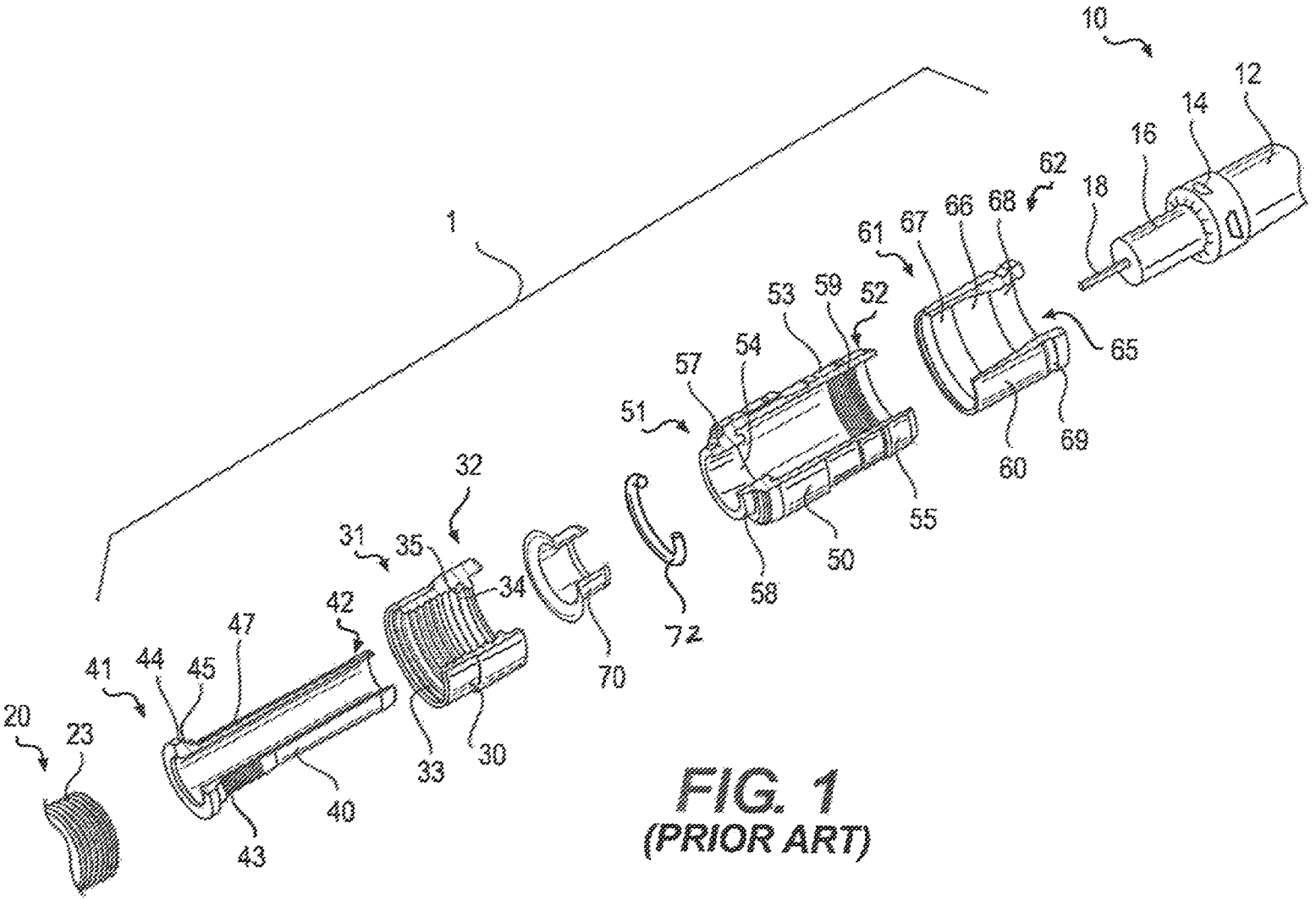
FIG. 1 (PRIOR ART)
FIG. 1 is an exploded perspective view of a conventional coaxial cable connector.

Referring to the drawings, FIG. 1 depicts a conventional coaxial cable connector 1. The coaxial cable connector 1 may be operably affixed, or otherwise functionally attached, to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the connector 1 may be configured to be coupled with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's operable electrical interface with the connector 1. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, the conventional coaxial cable connector 1 may include a coupler, for example, a coupler 30 (e.g. a threaded nut), a post member 40, a connector body 50, a fastener member 60, a grounding member 70 formed of conductive material, and a connector body sealing member 72, such as, for example, a body O-ring configured to fit around a portion of the connector body 50. The nut 30 at the front end of the post 40 serves to attach the connector 1 to an interface port.

The threaded nut 30 of the coaxial cable connector 1 has a first forward end 31 and opposing second rearward end 32. The threaded nut 30 may comprise internal threading 33 extending axially from the edge of first forward end 31 a distance sufficient to provide operably effective threadable contact with the external threads 23 of the standard coaxial cable interface port 20. The threaded nut 30 includes an internal lip 34, such as an annular protrusion, located proximate the second rearward end 32 of the nut. The internal lip 34 includes a surface 35 facing the first forward end 31 of the nut 30. The forward facing surface 35 of the lip 34 may be a tapered surface or side facing the first forward end 31 of the nut 30. The structural configuration of the nut 30 may vary according to differing connector design parameters to accommodate different functionality of a coaxial cable connector 1. For instance, the first forward end 31 of the nut 30 may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 31 of a nut 30, when mated with the interface port 20. Moreover, the second rearward end 32 of the nut 30 may extend a significant axial distance to reside radially extent, or otherwise partially surround, a portion of the connector body 50, although the extended portion of the nut 30 need not contact the connector body 50. The threaded nut 30 may be formed of conductive materials, such as copper, brass, aluminum, or other metals or metal alloys, facilitating grounding through the nut 30. Accordingly, the nut 30 may be configured to extend an electromagnetic buffer by electrically contacting conductive surfaces of an interface port 20 when a connector 1 is advanced onto the port 20. In addition, the threaded nut 30 may be formed of both conductive and non-conductive materials. For example, the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, injection molding, blow molding, combinations thereof, or other fabrication methods that may provide efficient production of the component. The forward facing surface 35 of the nut 30 faces a flange 44 of the post 40 when operably assembled in a connector 1, so as to allow the nut to rotate with respect to the other component elements, such as the post 40 and the connector body 50, of the connector 1.

Referring still to FIG. 1, the connector 1 may include a post 40. The post 40 may include a first forward end 41 and an opposing second rearward end 42. Furthermore, the post 40 may include a flange 44, such as an externally extending annular protrusion, located at the first end 41 of the post 40.

The flange 44 includes a rearward facing surface 45 that faces the forward facing surface 35 of the nut 30, when operably assembled in a coaxial cable connector 1, so as to allow the nut to rotate with respect to the other component elements, such as the post 40 and the connector body 50, of the connector 1. The rearward facing surface 45 of flange 44 may be a tapered surface facing the second rearward end 42 of the post 40. Further still, an embodiment of the post 40 may include a surface feature 47 such as a lip or protrusion that may engage a portion of a connector body 50 to secure axial movement of the post 40 relative to the connector body 50. However, the post need not include such a surface feature 47, and the coaxial cable connector 1 may rely on press-fitting and friction-fitting forces and/or other component structures having features and geometries to help retain the post 40 in secure location both axially and rotationally relative to the connector body 50. The location proximate or near where the connector body is secured relative to the post 40 may include surface features 43, such as ridges, grooves, protrusions, or knurling, which may enhance the secure attachment and locating of the post 40 with respect to the connector body 50. Moreover, the portion of the post 40 that contacts embodiments of the grounding member 70 may be of a different diameter than a portion of the nut 30 that contacts the connector body 50. Such diameter variance may facilitate assembly processes. For instance, various components having larger or smaller diameters can be readily press-fit or otherwise secured into connection with each other. Additionally, the post 40 may include a mating edge 46, which may be configured to make physical and electrical contact with a corresponding mating edge 26 of the interface port 20. The post 40 should be formed such that portions of a prepared coaxial cable 10 including the dielectric 16 and center conductor 18 may pass axially into the second end 42 and/or through a portion of the tube-like body of the post 40. Moreover, the post 40 should be dimensioned, or otherwise sized, such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, combinations thereof, or other fabrication methods that may provide efficient production of the component.

The coaxial cable connector 1 may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 1. The internal surface of the post mounting portion 57 may include an engagement feature 54 that facilitates the secure location of the grounding member 70 with respect to the connector body 50 and/or the post 40, by physically engaging the grounding member 70 when assembled within the connector 1. The engagement feature 54 may simply be an annular detent or ridge having a different diameter than the rest of the post mounting portion 57. However other features such as grooves, ridges, protrusions, slots, holes, keyways, bumps, nubs, dimples, crests, rims, or other like structural features may be included to facilitate or possibly assist the positional retention of embodiments of the electrical grounding member 70 with respect to the connector body 50. Nevertheless, embodiments of the grounding member 70 may also reside in a secure position with respect to the connector body 50 simply through press-fitting and friction-fitting forces engendered by corresponding tolerances, when the various coaxial cable connector 1 components are operably assembled, or otherwise physically aligned and attached together. Various exemplary grounding members 70 are illustrated and described in U.S. Pat. No. 8,287,320, the disclosure of which is incorporated herein by reference. In addition, the connector body 50 may include an outer annular recess 58 located proximate or near the first end 51 of the connector body 50. Furthermore, the connector body 50 may include a semi-rigid, yet compliant outer surface 55, wherein an inner surface opposing the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, the coaxial cable connector 1 may include a fastener member 60. The fastener member 60 may have a first end 61 and opposing second end 62. In addition, the fastener member 60 may include an internal annular protrusion 63 located proximate the first end 61 of the fastener member 60 and configured to mate and achieve purchase with the annular detent 53 on the outer surface 55 of connector body 50. Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 1. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 10, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector 1 may be fastened to a received coaxial cable 10 may also be similar to the way a cable is fastened to a common CMP-type connector having an insertable compression sleeve that is pushed into the connector body 50 to squeeze against and secure the cable 10. The coaxial cable connector 1 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield or sheath 14 of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 1 between a first open position (accommodating insertion of the tubular inner post 40 into a prepared cable 10 end to contact the grounding shield 14), and a second clamped position compressibly fixing the cable 10 within the chamber of the connector 1, because the compression sleeve is squeezed into restraining contact with the cable 10 within the connector body 50.

Referring now to FIGS. 2-8, an exemplary embodiment of a sleeve 180, for example, a torque sleeve, may be coupled to a coaxial cable connector 100, which includes many of the features described above relative to the conventional coaxial connector 1 and is used to terminate a prepared end of the coaxial cable 10. A variety of other coaxial cable connectors may be adapted for use with the sleeve 180 of the present invention, such as the connectors described in U.S. Pat. No. 5,470,257 to Szegda or U.S. Pat. No. 6,153,830 to Montena, which are incorporated by reference herein in their entirety.

The connector 100 is configured and dimensioned to accommodate receiving the prepared end of a coaxial cable 10. The connector 100 includes a coupler 130 (e.g. a threaded nut), a forward grounding member 136, a post member 140, a connector body 150, a fastener member 160, a grounding member 170 formed of conductive material, and a connector body sealing member 172, such as, for example, a body O-ring configured to fit around a portion of the connector body 150. The coupler 130, the post member 140, the connector body 150, the fastener member 160, the grounding member 170 formed of conductive material, and the connector body sealing member 172 are similar to the like parts described above in connection with the conventional connector 1.

Figure 2:
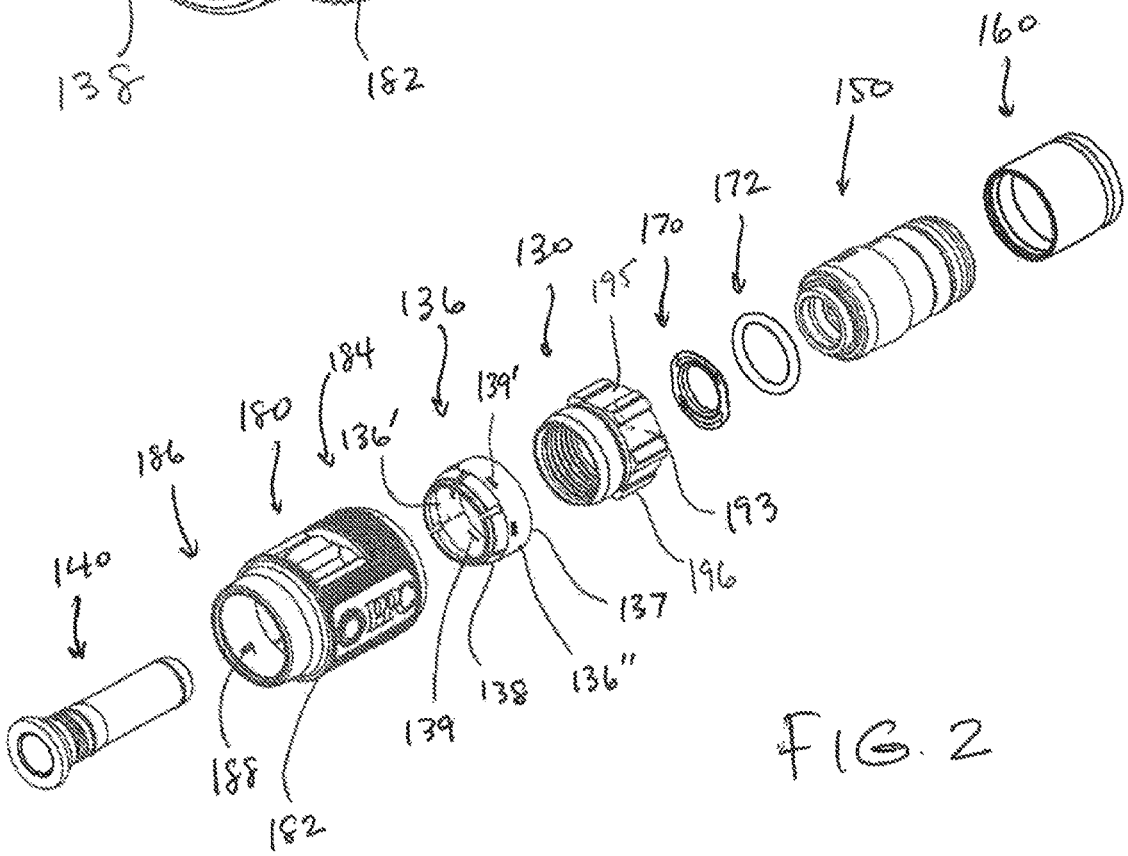
FIG. 2 is an exploded perspective view of a coaxial cable connector including an exemplary sleeve in accordance with various aspects of the disclosure.
Figure 4:
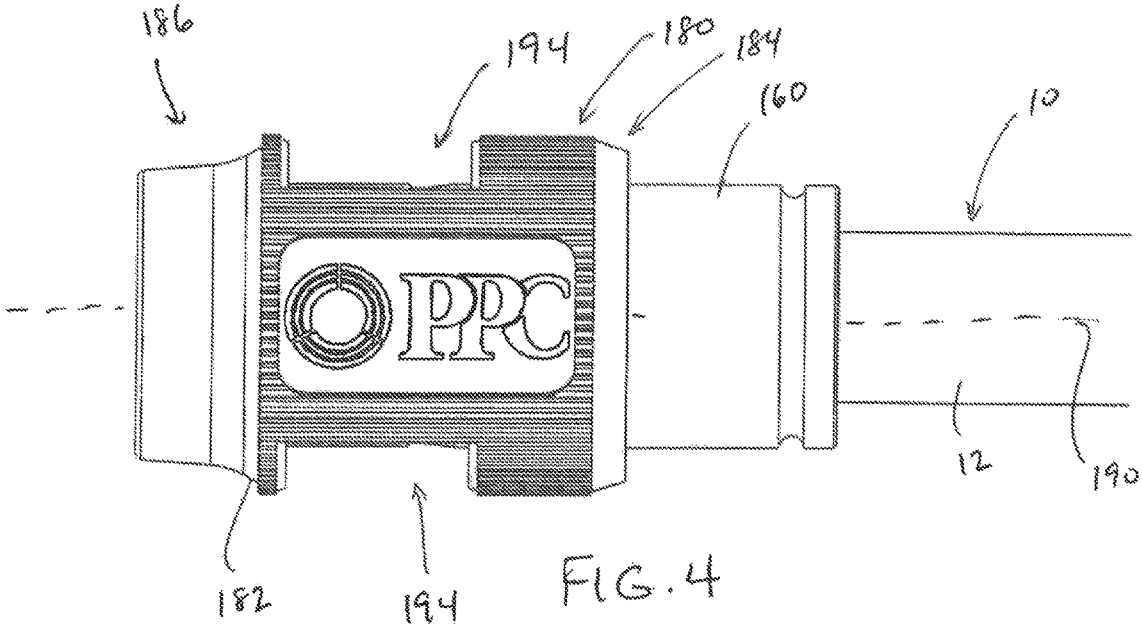
FIG. 4 is a side view of the connector and sleeve of FIG. 3.

As illustrated in FIG. 2, the coupler 130 may include a forward portion 131 having an annular outer surface and a rearward portion 133 having a hexagonal outer surface or contour 193. For example, the hexagonal outer surface 193 may include six hexagonal flats 195 arranged successively about the periphery of the coupler 130 and separated from one another by six corner portions 196.

The forward grounding member 136 is connected with the coupler 130 such that the forward grounding member 136 extends about a periphery of the forward portion 131 of the coupler 130. The forward grounding member 136 includes a rear collar portion 137 and forward grounding fingers 138. The forward grounding member 136 may be connected with the coupler 130 in any manner that ensures a ground path between the coupler 130 and the forward grounding member 136, such as, for example, a snap fit, interference fit, press fit, or the like. For example, as shown in FIG. 2, the forward grounding member 136 may include protrusions 139 extending radially inward from an inner surface 136' of the forward grounding member 136. The protrusions 139 result in an inside diameter of the rear collar portion 137 of the forward grounding member 136 being slightly smaller than the outside diameter of the coupler 130 so that the forward grounding member 136 can be securely connected with the coupler 130 by an interference fit. It should be appreciated that, in some embodiments, the coupler 130 and the forward grounding member 136 may be configured as a single monolithic piece of unitary construction.

The grounding fingers 138 may be formed by cuts in the forward grounding member 136. The grounding fingers 138 are configured to project radially inward such that the resulting inside diameter of the grounding fingers 138 is smaller than the outside diameter of the interface port 20. The grounding fingers 138 are constructed of a material having sufficient resiliency such that the fingers 138 are configured to deflect radially outward to receive the interface port 20 therein when the coupler 130 is coupled with the interface port 20, while remaining biased radially inward. The fingers 138 remain biased radially inward to maintain constant contact with the threaded exterior surface 23 of the interface port 20 at all times, for example, even when the coupler 130 is not fully tightened to the interface port 20. Thus, even when the coupler 130 is loosely coupled (i.e., partially or loosely tightened) with the interface port 20, electrical ground between the coupler 130 and the interface port 20 is maintained.

As shown in FIGS. 3-8, the sleeve 180, such as, for example, a torque sleeve or a gripping sleeve, extends about a periphery of the coupler 130 and the forward grounding member 136. In some embodiments, the sleeve 180 may be constructed of rubber, plastic, an elastomer, or the like. The sleeve 180 may be coupled with the coupler 130 and the forward grounding member 136 through a press-fit, snap-fit, interference-fit, or any other coupling relationship. As shown in FIG. 2, the forward grounding member 136 may include protrusions 139' extending radially outward from an outer surface 136" of the forward grounding member 136. The protrusions 139' result in an outside diameter of the rear collar portion 137 of the forward grounding member 136 being slightly larger than the inside diameter of the sleeve 180 so that the forward grounding member 136 can be securely connected with the sleeve 180 by an interference fit. Thus, rotation of the sleeve 180 rotates the forward grounding member 136 to attach the connector 100 to a system component, for example, the threaded port 20 or the like.

The sleeve 180 includes a generally cylindrical body 182 having a first end 184 and a second end 186 defining a bore 188 along a longitudinal axis 190. As would be understood by persons skilled in the art, the external surface of the body 182 of the sleeve 180 may be textured to assist a user in turning the sleeve 180 by hand. The texture may be grooved, splined, or knurled for example. Alternatively, the external shape of the sleeve body 182 may be a prism, elliptical, cylindrical, or have flats or concavities to assist the user in grasping and manipulating the sleeve 180.

Figure 6:
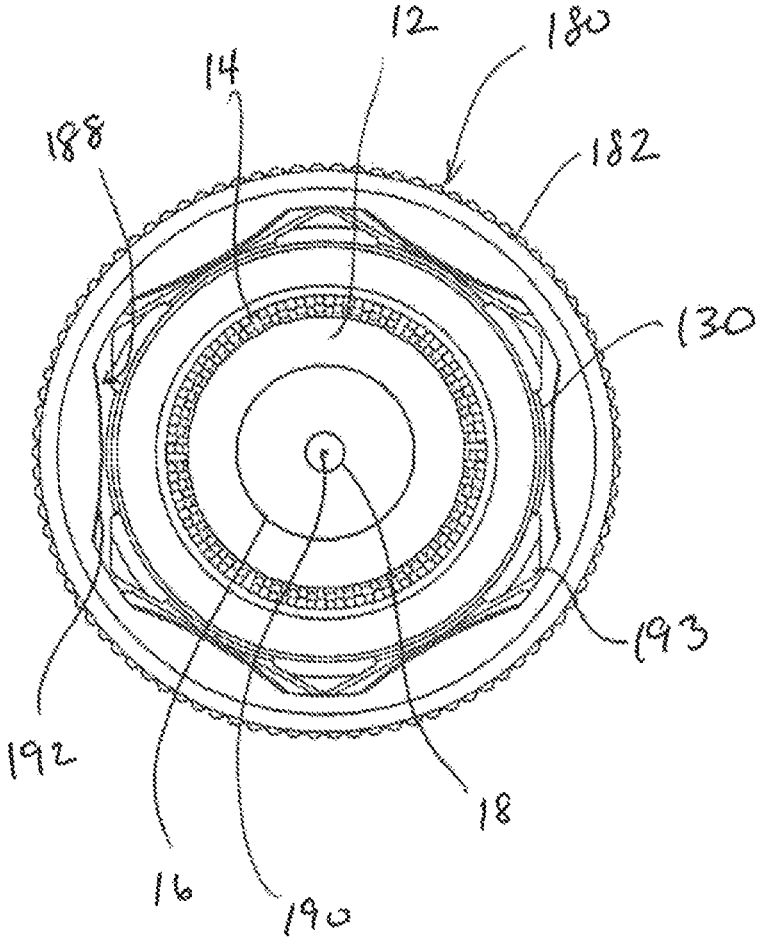
FIG. 6 is a rear end view of the connector and sleeve of FIG. 3.
Figure 7:
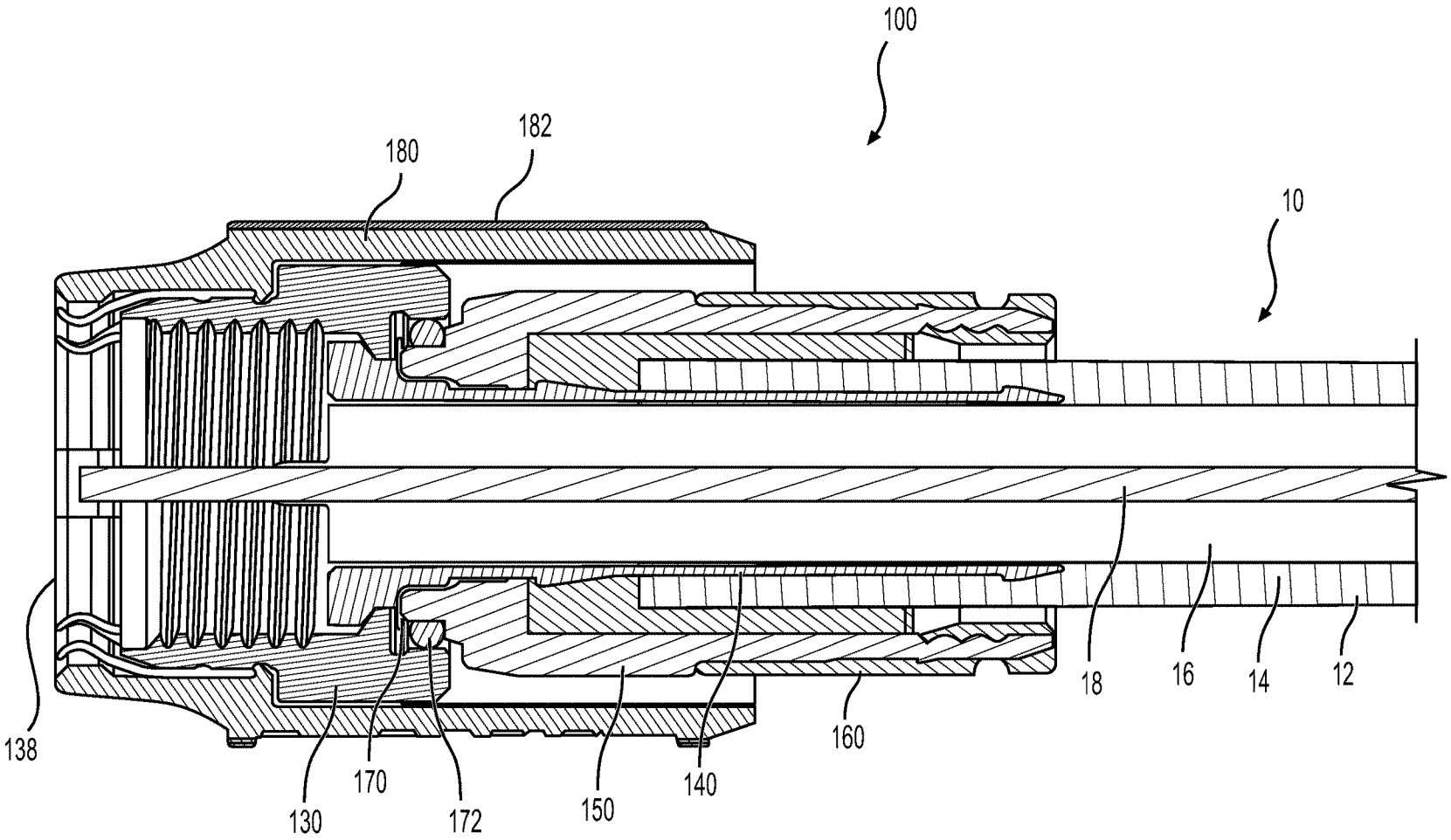
FIG. 7 is a top view of the connector and sleeve of FIG. 3 assembled on a coaxial cable.
Figure 8:
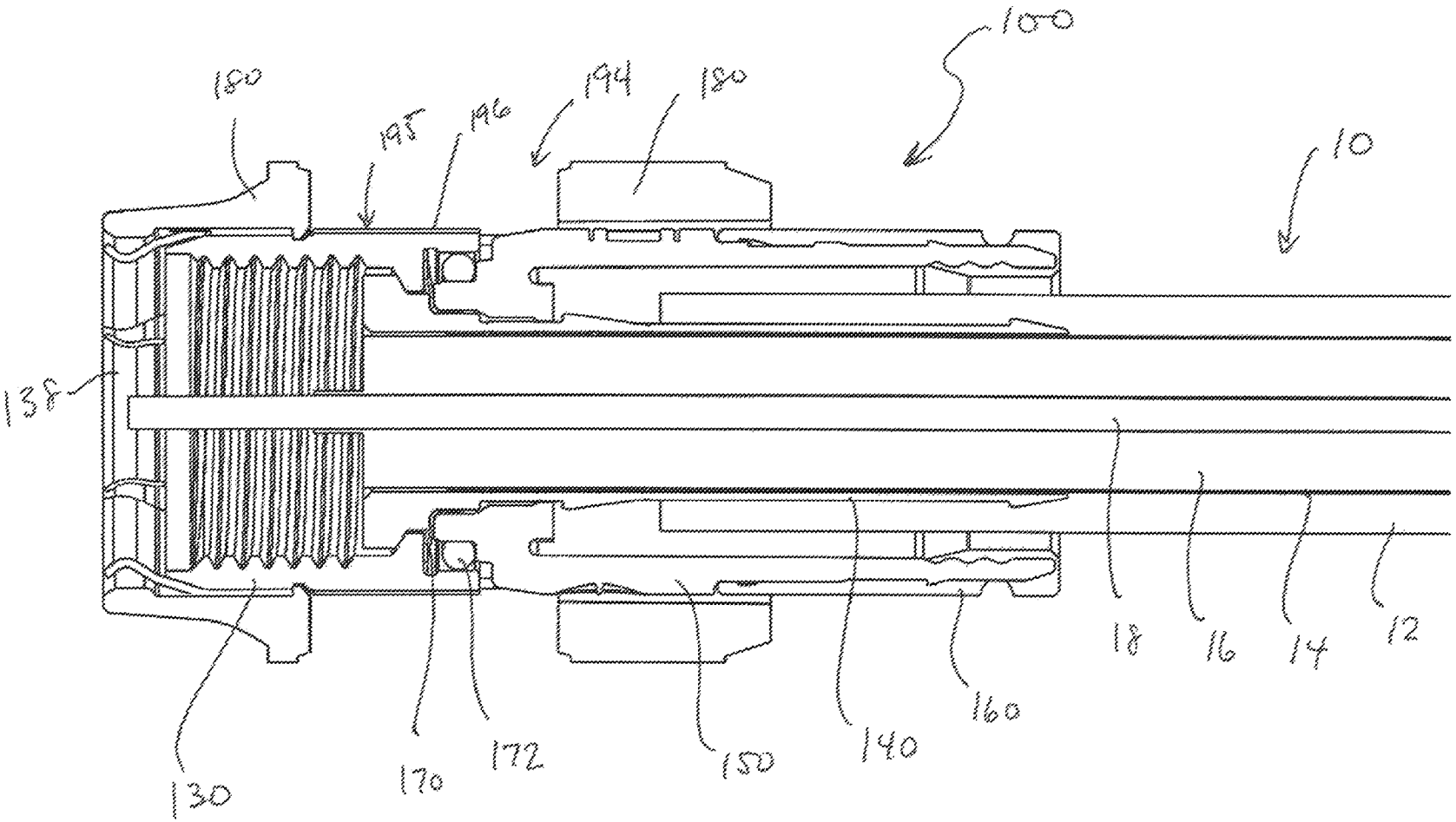
FIG. 8 is a side view of the connector and sleeve of FIG. 3 assembled on a coaxial cable.

As best illustrated in FIG. 2, the bore 188 of the cylindrical body 182 defines an interior surface 192 that includes a torque transmission feature in the first end 184 of the body 182. The torque transmission feature defines a geometric shape to match the contour of the rearward portion 133 of the coupler 130. The contour may be sized for a line-on-line fit with an outer contour 193 of the rearward portion 133 of the coupler 130. As shown in FIG. 6, the torque transmission feature of the interior surface 192 forms a hexagonal shape to match the hexagonal outer surface of the rearward portion 133 of the coupler 130.

Because the interior surface 192 in the first end 184 of the cylindrical body 182 defines a geometric shape matching the contour of the rearward portion 133 of the coupler 130, the sleeve 180 effects torque transmission to the coupler 130. Thus, the coupler 130 may be hand-tightened to a first torque without the use of a wrench (e.g., up to about 10 in.lb. of torque). The outer contour of the cylindrical body 182 may include grooves, knurls, ribs, or other features to prevent slippage during the tightening or loosening operations. In one embodiment, the only radial contact surface between the sleeve 180 and the coaxial cable connector 100 is at the coupler 130 interface, for example, at the rearward portion 133 of the coupler 130. For example, in the disclosed embodiment, the radial contact is limited to the hexagonal flats. As can be appreciated with reference to FIG. 2, adequate clearance may be designed between the sleeve 180 and the connector body 150, and between the sleeve 180 and the fastener member 160, so as to allow the coupler 130 to rotate freely without creating drag on other components of the connector 100.

Figure 3:
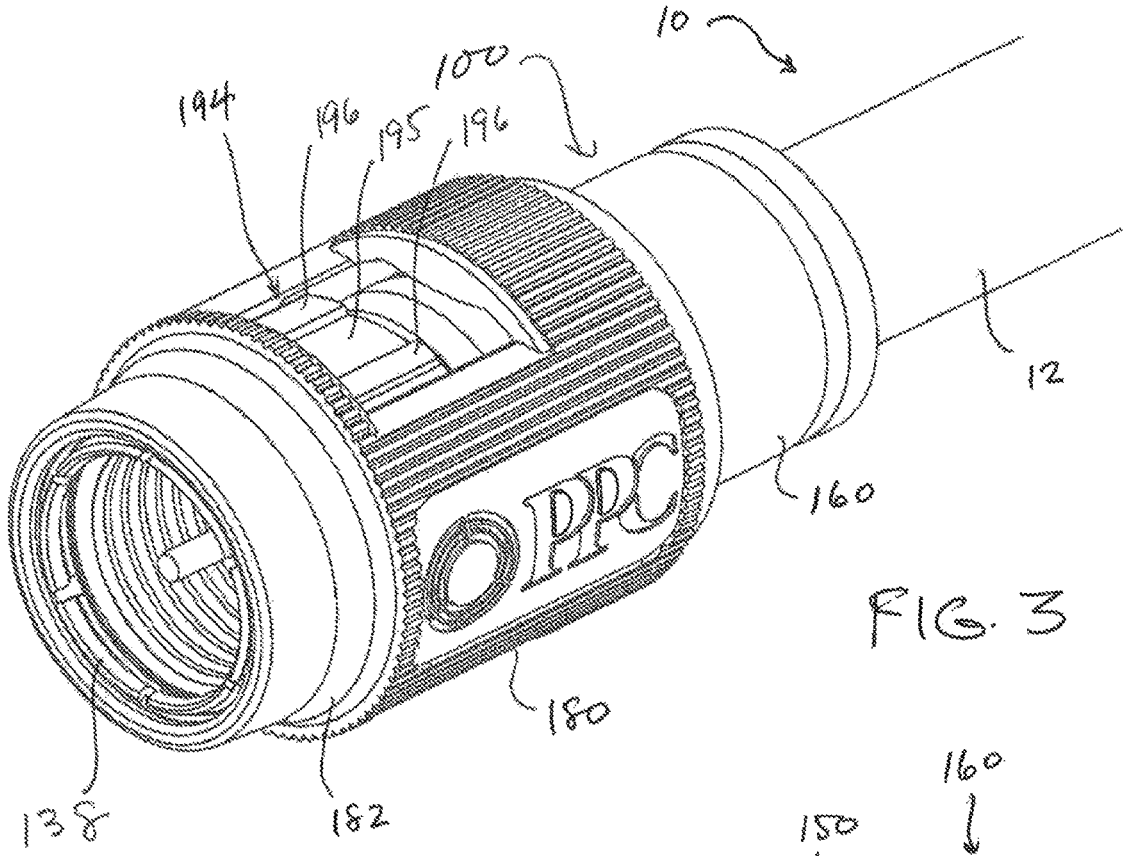
FIG. 3 is a perspective view of the connector and sleeve of FIG. 2 attached to a coaxial cable.
Figure 5:
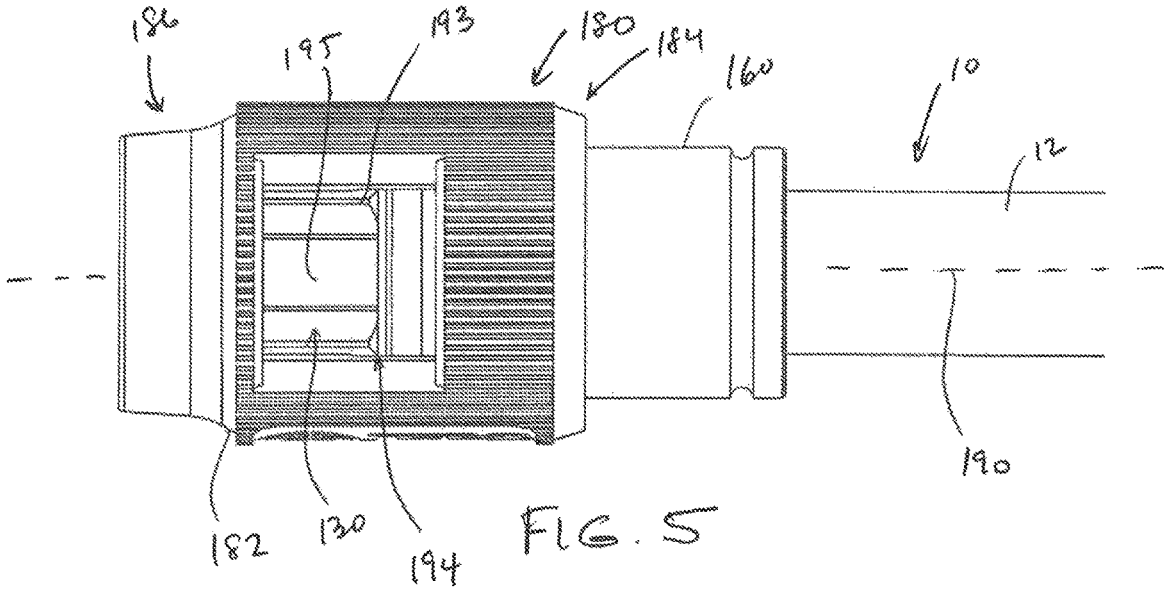
FIG. 5 is a top view of the connector and sleeve of FIG. 3.

The cylindrical body 182 of the sleeve 180 includes a pair of diametrically opposed cutouts 194. Each of the cutouts 194 extends about only a portion of the periphery of the rearward portion 133 of the coupler 130 in a direction transverse, for example, perpendicular, to the axis 190. The cutouts 194 are arranged relative to the shape of the interior surface 192 of the cylindrical body 182 such that the cutouts 184 are aligned with diametrically opposed flat surfaces 195 of the hex-shaped coupler 130 surrounded by the cylindrical body 182. As best shown in FIGS. 3 and 5, each of the cutouts 184 is sized and arranged to receive one hexagonal flat 195 and two corner portions 195, one at each end the hexagonal flat 195 in a direction transverse, for example, perpendicular, to the axis 190. Thus, the cutouts 194 are configured to receive jaws of a wrench and permit such jaws to engage two diametrically opposed hexagonal flats 195 and/or the two corner portions 195 that are exposed in each of the cutouts 184 such that the wrench can grip the rearward portion 133 of the coupler 130 so as to be used to tighten the coupler 130 to the interface port 20 up to a second desired torque that is greater than the first torque attainable via hand tightening.

One advantage of the present invention is that a coaxial cable connector and jumper cable may be installed onto a corresponding electronic device up to a first torque (e.g., 10 in.lb.) without having to resort to the use of a wrench, while facilitating use of a wrench to install the connector onto a device up to a second desired torque (e.g., 30 in.lb.) that is greater than the first torque. This is particularly desirable when access to the electronic device is limited, or the device is housed in an enclosed space that is restricted. In such situations, a secure and reliable connection may be established by use of hand-tightening. Meanwhile, when access to the electronic device is not limited or when a torque greater than the first torque is desirable (e.g., when connecting the connector 100 to wall plates and splitters), the cutouts 194 facilitate the use of a wrench, which can achieve an even tighter and more secure connection between the coupler 130 and the port 20 than hand-tightening. Without the sleeve 180 of the present invention, tightening the coupler 130 on the port 20 may be difficult, resulting in only a few threads being engaged. In contrast, using the sleeve 180, greater torque transmission may be realized in all situations, resulting in a tighter, more secure connection between the coupler 130 and the port 20 in all situations.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A torque sleeve configured to be coupled to a coaxial cable connector, which is used to terminate a prepared end of a coaxial cable, the torque sleeve comprising:

a sleeve body configured to extend about a periphery of a coupler and be coupled with the coupler;

wherein the sleeve body includes a bore configured to define an interior surface that includes a torque transmission feature, the torque transmission feature defining a hexagonal shape configured to match a hexagonal outer surface of the coupler;

wherein the sleeve body includes a pair of opposed cutouts, each of the cutouts extending about a portion of a periphery of the coupler, the cutouts being configured to be aligned with opposed flat surfaces of the hexagonal outer surface of the coupler;

wherein each of the cutouts is sized and arranged to receive one flat surface of the hexagonal outer surface of the coupler; and wherein the cutouts are configured to receive jaws of a wrench and permit such jaws to engage the flat surface and/or the two corner portions that are exposed in each of the cutouts such that the wrench can grip the coupler to tighten the coupler to an interface port up to a second desired torque that is greater than a first torque attainable via hand tightening.

2. A connector assembly comprising:

the torque sleeve of claim 1;

a connector including a coupler, a post member coupled with the coupler, a connector body coupled with the post, and a fastener member configured to coupled the connector with the prepared end of the coaxial cable; and wherein the coupler is configured to rotate relative to the post member and the connector body.

3. The connector assembly of claim 2, wherein the coupler includes a forward portion having an annular outer surface and a rearward portion having the hexagonal outer surface.

4. The connector assembly of claim 3, further comprising a forward grounding member coupled with the forward portion of the coupler.

5. The connector assembly of claim 4, wherein the forward grounding member includes a rear collar portion and forward grounding fingers, the forward grounding fingers being configured to extend forward from the coupler.

6. The connector assembly of claim 5, wherein the grounding fingers are configured to project radially inward from the rear collar portion such that an inside diameter of the grounding fingers is smaller than an outside diameter of an interface port;

wherein the grounding fingers configured to deflect radially outward to receive the interface port therein when the coupler is coupled with the interface port; and wherein the fingers are configured to remain biased radially inward to maintain constant contact with the threaded exterior surface of the interface port even when the coupler is not fully tightened to the interface port.

7. A torque sleeve configured to be coupled to a coaxial cable connector, the torque sleeve comprising:

a sleeve body configured to extend about a periphery of a coupler and be coupled with the coupler;

wherein the sleeve body includes a pair of opposed cutouts, each of the cutouts extending about a portion of a periphery of the coupler, the cutouts being configured to be aligned with opposed flat surfaces of a hexagonal outer surface of a coupler;

wherein each of the cutouts is sized and arranged to receive one flat surface of the hexagonal outer surface of the coupler; and wherein the cutouts are configured to receive jaws of a wrench and permit such jaws to engage the flat surface and/or the two corner portions that are exposed in each of the cutouts such that the wrench can grip the coupler to tighten the coupler to an interface port up to a second desired torque that is greater than a first torque attainable via hand tightening.

8. A connector assembly comprising:

the torque sleeve of claim 7;

a connector including a coupler, a post member coupled with the coupler, a connector body coupled with the post, and a fastener member configured to coupled the connector with the prepared end of the coaxial cable; and wherein the coupler is configured to rotate relative to the post member and the connector body.

9. The connector assembly of claim 8, wherein the coupler includes a forward portion having an annular outer surface and a rearward portion having the hexagonal outer surface.

10. The connector assembly of claim 9, further comprising a forward grounding member coupled with the forward portion of the coupler.

11. The connector assembly of claim 10, wherein the forward grounding member includes a rear collar portion and forward grounding fingers, the forward grounding fingers being configured to extend forward from the coupler.

12. The connector assembly of claim 11, wherein the grounding fingers are configured to project radially inward from the rear collar portion such that an inside diameter of the grounding fingers is smaller than an outside diameter of an interface port;

wherein the grounding fingers configured to deflect radially outward to receive the interface port therein when the coupler is coupled with the interface port; and wherein the fingers are configured to remain biased radially inward to maintain constant contact with the threaded exterior surface of the interface port even when the coupler is not fully tightened to the interface port.

13. A torque sleeve comprising:

a sleeve body configured to extend along an axis, the sleeve body further configured to at least partially receive a coupler of a coaxial cable connector;

wherein the sleeve body includes a pair of opposed cutouts, each of the cutouts extending about a portion of a periphery of the coupler, the cutouts being configured to be aligned with opposed flat surfaces of a hexagonal outer surface of a coupler; and wherein each of the cutouts is sized and arranged to receive one flat surface of the hexagonal outer surface of the coupler.

14. The torque sleeve of claim 13, wherein the sleeve body has an outer surface configured to permit a user to tighten the coupler to an interface port up to a first torque; and wherein the cutouts are configured to receive a tightening tool so as to permit the tightening tool to grip the coupler and tighten the coupler to an interface port up to a second torque, the second torque being greater than the first torque.

15. A connector assembly comprising:

the torque sleeve of claim 13;

a connector including a coupler, a post member coupled with the coupler, a connector body coupled with the post, and a fastener member configured to coupled the connector with the prepared end of the coaxial cable; and wherein the coupler is configured to rotate relative to the post member and the connector body.

16. The connector assembly of claim 15, wherein the coupler includes a forward portion having an annular outer surface and a rearward portion having the hexagonal outer surface.

17. The connector assembly of claim 16, further comprising a forward grounding member coupled with the forward portion of the coupler.

18. The connector assembly of claim 17, wherein the forward grounding member includes a rear collar portion and forward grounding fingers, the forward grounding fingers being configured to extend forward from the coupler.

19. The connector assembly of claim 18, wherein the grounding fingers are configured to project radially inward from the rear collar portion such that an inside diameter of the grounding fingers is smaller than an outside diameter of an interface port;

wherein the grounding fingers configured to deflect radially outward to receive the interface port therein when the coupler is coupled with the interface port; and wherein the fingers are configured to remain biased radially inward to maintain constant contact with the threaded exterior surface of the interface port even when the coupler is not fully tightened to the interface port.

20. The torque sleeve of claim 13, wherein the sleeve body includes a bore configured to define an interior surface that includes a torque transmission feature, the torque transmission feature defining a hexagonal shape configured to match a hexagonal outer surface of the coupler.

21. The torque sleeve of claim 20, wherein each of the cutouts is sized and arranged to receive one flat surface of the hexagonal outer surface of the coupler and two corner portions of the hexagonal outer surface of the coupler, the corner portions being at each end the flat surface in a direction about a periphery of the coupler.

22. A torque sleeve comprising:

a body configured to extend along an axis;

wherein the body is configured to at least partially receive a coupler of a coaxial cable connector;

wherein the body includes a cutout portion that is configured to extend about a portion of a periphery of the coupler;

wherein the cutout portion is configured to be aligned with opposed flat surfaces of the coupler; and wherein the cutout portion is configured to receive a tightening tool so as to permit the tightening tool to grip the coupler and tighten the coupler to an interface port up to a second torque, the second torque being greater than the first torqued.

23. A connector assembly comprising:

the torque sleeve of claim 22;

a connector including a coupler, a post member coupled with the coupler, a connector body coupled with the post, and a fastener member configured to coupled the connector with the prepared end of the coaxial cable; and wherein the coupler is configured to rotate relative to the post member and the connector body.

24. The connector assembly of claim 23, wherein the coupler includes a forward portion having an annular outer surface and a rearward portion having the hexagonal outer surface.

25. The connector assembly of claim 24, further comprising a forward grounding member coupled with the forward portion of the coupler.

26. The connector assembly of claim 25, wherein the forward grounding member includes a rear collar portion and forward grounding fingers, the forward grounding fingers being configured to extend forward from the coupler.

27. The connector assembly of claim 26, wherein the grounding fingers are configured to project radially inward from the rear collar portion such that an inside diameter of the grounding fingers is smaller than an outside diameter of an interface port;

wherein the grounding fingers configured to deflect radially outward to receive the interface port therein when the coupler is coupled with the interface port; and wherein the fingers are configured to remain biased radially inward to maintain constant contact with the threaded exterior surface of the interface port even when the coupler is not fully tightened to the interface port.

28. The torque sleeve of claim 22, wherein the body includes a receiving structure configured to define an interior surface that includes a torque transmission feature, the torque transmission feature defining a hexagonal shape configured to match a hexagonal outer surface of the coupler.

29. The torque sleeve of claim 28, wherein the cutout portion comprises a pair of opposed cutout regions; and wherein each of the cutout regions is sized and arranged to receive one flat surface of the hexagonal outer surface of the coupler and two corner portions of the hexagonal outer surface of the coupler, the corner portions being at each end the flat surface in a direction about a periphery of the coupler.

30. The torque sleeve of claim 22, wherein the cutout portion comprises a pair of opposed cutout regions.

* * * * *